US006761626B2

(12) United States Patent
de la Llera et al.

(10) Patent No.: US 6,761,626 B2
(45) Date of Patent: Jul. 13, 2004

(54) AIR PLATEN FOR LEADING EDGE AND TRAILING EDGE CONTROL

(75) Inventors: Anthony de la Llera, Union City, CA (US); Xuyen Pham, Fremont, CA (US); Cangshan Xu, Fremont, CA (US); David Wei, Fremont, CA (US); Tony Luong, San Jose, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 10/037,452

(22) Filed: Dec. 20, 2001

(65) Prior Publication Data

US 2003/0119433 A1 Jun. 26, 2003

(51) Int. Cl.[7] ..... B24B 7/22; B24B 21/08
(52) U.S. Cl. ..... 451/303; 451/307; 451/303
(58) Field of Search ..... 451/307, 303, 451/288, 296, 41, 72

(56) References Cited

U.S. PATENT DOCUMENTS 3,099,904 A * 8/1963 Bell ..... 451/303
5,558,568 A 9/1996 Talieh et al.
5,593,344 A * 1/1997 Weldon et al. ..... 451/296
5,722,877 A 3/1998 Meyer et al.
5,800,248 A * 9/1998 Pant et al. ..... 451/41
5,916,012 A 6/1999 Pant et al.
5,961,372 A * 10/1999 Shendon ..... 451/41
5,980,368 A * 11/1999 Chang et al. ..... 451/303
6,086,456 A * 7/2000 Weldon et al. ..... 451/41

OTHER PUBLICATIONS

U.S. patent application Ser. No. 09/925,254: "Platen Assembly Having a Topographically Altered Platen Surface"; Inventors: Taylor et al.; Filed Aug. 8, 2001.

* cited by examiner

*Primary Examiner*—Robert A. Rose
(74) *Attorney, Agent, or Firm*—Brinks Hofer Gilson & Lione

(57) ABSTRACT

An air platen assembly is described and includes a platen that has a plurality of concentric rings. Each of the rings has a plurality of openings in order to provide a cushion of air to a CMP belt. At least one of the rings extends beyond an outer edge of a wafer to be planarized by the CMP belt. A support is attached with the platen and has a plurality of air ports for pressurized air to pass to the rings of the platen. A gasket is positioned between the support and the platen and has a plurality of cutouts that align with the openings and the air ports. A base is also included and supports the support.

11 Claims, 5 Drawing Sheets

AIR PLATEN FOR LEADING EDGE AND TRAILING EDGE CONTROL

FIELD OF THE INVENTION

The present invention relates generally to equipment for processing semiconductor wafers. More particularly, the present invention relates to an air platen used to support a linear belt during the chemical mechanical polishing of semiconductor wafers.

BACKGROUND

Chemical mechanical polishing (CMP) is used for planarizing semiconductor wafers during processing of the wafers. Because semiconductor circuits on wafers are commonly constructed in layers, where a portion of a circuit is created on a first layer and conductive vias connect it to a portion of the circuit on the next layer, each layer can add or create topography on the wafer that must be smoothed out before generating the next layer. In order to improve the manufacturability of the circuits on the wafer, many processing steps require planarizing the wafer surface. For example, to improve the uniformity of deposition of the conductive vias, the wafer is planarized prior to deposition to reduce the peaks and valleys on the surface over which the metal is deposited.

In conventional planarization technology, a rotating wafer carrier head brings the wafer into contact with a polishing pad rotating in the plane of the wafer surface to be planarized, and pressure is applied to a semiconductor wafer in order to support the wafer face down against a moving polishing pad. One type of polishing or planarizing apparatus is the linear polisher. In linear planarizing technology, an endless belt travels over two or more rollers. The wafer is placed against the moving polishing surface of the belt. An example of a linear polishing system is the Teres™ CMP System manufactured by Lam Research Corporation, Fremont, Calif.

A key component of a linear CMP system is the air platen. The air platen provides a cushion of air via air channels to support the belt as pressure is applied to the wafer. However, existing air platen may not provide a cushion of air that takes into account variations in the wafer surface when it is placed against the belt surface, leading to a wafer that is not uniformly polished. If this occurs, there may be topography that is not removed from the wafer surface, or else the wafer surface may be planarized to the point where pitting will occur on the wafer surface.

Another problem that is associated with air platen is that the portions of the belt that support the edge of the wafer often themselves are not properly supported by the air platen. This may result in what is known as edge exclusion. Edge exclusion categorically is a portion of the wafer edge that does not receive the same degree of polishing action as the balance of the wafer. The result is a reduction of usable area for product production.

Accordingly, there is a need in the art for an improved air platen for CMP systems.

BRIEF SUMMARY

In order to address the need for improved planarization or polishing control by a wafer's edge, a platen assembly for supporting a polishing member, such as a linear belt on a linear polishing apparatus, is described below. According to one aspect of the invention, an air platen assembly is disclosed that includes a platen having a plurality of concentric rings. Each ring has a plurality of openings in order to provide a cushion of air to a CMP belt, and at least one of the rings extends beyond an outer edge of a wafer to be planarized by the CMP belt. A support is attached with the platen, and has a plurality of air ports for pressurized air to pass to the rings of the platen. A gasket is positioned between the support and the platen, and has a plurality of cutouts that align with the openings and the air ports. Also included is a base that supports the support.

According to another aspect of the invention, an air platen is disclosed that includes a plurality of concentric rings. Each ring has a plurality of channels in order to provide a cushion of air to a CMP belt. Each ring, except for two inner-most rings, has a top quarter, a bottom quarter, a leading edge quarter, and a trailing edge quarter. Each of the quarters and the inner-most rings is an independent air passage for receiving a supply of pressurized air. At least one of the rings is oriented to extend beyond an outer edge of a wafer to be planarized by the CMP belt. One pressure regulator is connected with each of the inner-most rings, and three pressure regulators are connected with each of the remaining rings.

According to another aspect of the invention, the air platen includes eight concentric rings, with each ring having a plurality of channels in order to provide a cushion of air to a CMP belt. An outer six rings each has a top quarter, a bottom quarter, a leading edge quarter, and a trailing edge quarter. Each of the quarters and two inner-most rings are independent air passage for receiving a supply of pressurized air. There is one pressure regulator connected with each of the inner-most rings, and three pressure regulators connected with each of the six outer rings. One of the three regulators is connected with the top quarter and the bottom quarter, a second of the three regulators is connected with the leading edge quarter, and a third of the three regulators is connected with the trailing edge quarter of each of the remaining rings. In addition, there are two channels passing through the air platen, with each channel having a plurality of passages extending upwardly from the channel to a top surface of the air platen. At least one of the outer six rings extends beyond an outer edge of a wafer to be planarized by the CMP belt.

DETAILED DESCRIPTION OF THE PRESENTLY PREFERRED EMBODIMENTS

Figure 1:
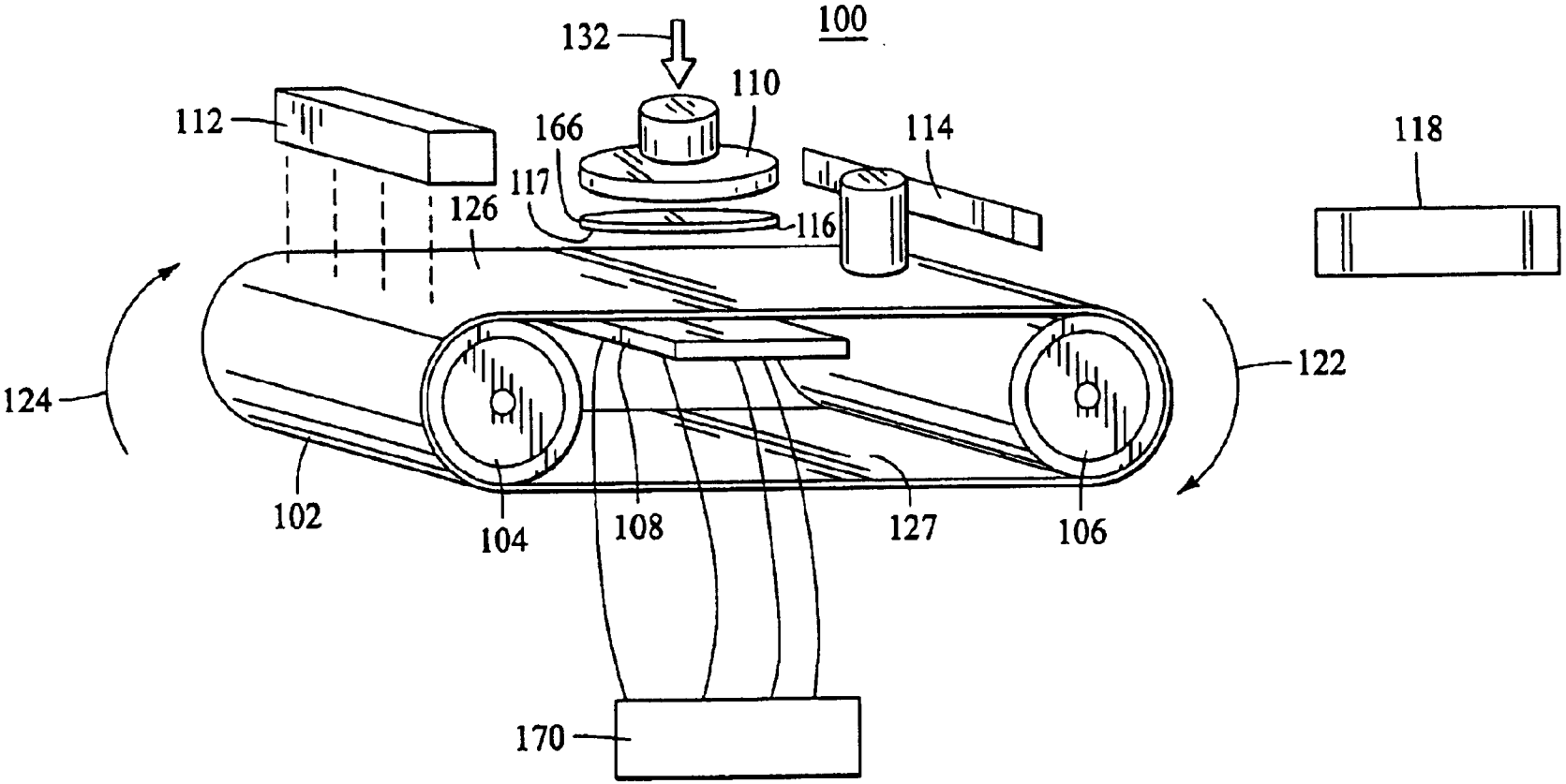
FIG. 1 is a perspective view of an embodiment of a linear chemical mechanical polishing system.

Referring now to the drawings, FIG. 1 is a perspective view of a linear chemical mechanical polishing or planarization (CMP) system 100 for polishing a workpiece. The system 100 in the illustrated embodiment is adapted for planarization of semiconductor wafers such as the semiconductor wafer 116. However, the operative principles embodied in the system 100 may be applied to chemical mechanical polishing of other workpieces as well. The wafer includes a polishing surface 117 that is polished by the CMP system 100 and an outer edge 166. The CMP system 100 includes a belt 102, a first roller 104, a second roller 106, a platen assembly 108, a polishing head 110, a slurry dispenser 112, a conditioner 114, and a controller 118.

The rollers 104, 106 are located a predetermined distance apart to retain the belt 102 and move the belt 102 to permit linear planarization of the wafer 116. The rollers 104, 106 are turned, for example, by an electric motor in the direction indicated by the arrows 122, 124. The rollers 104, 106 thus form a transport means for moving the belt 102 in a continuous loop past the wafer 116. Other transport means include combinations of wheels, pulleys and tensioning devices that maintain proper tension on the belt 102, along with their associated drive elements such as electric motors and mechanical linkages. Operational parameters such as the speed and tension of the belt 102 are controlled through the rollers 104, 106 by the controller 118. The controller 118 may include a processor or other computing device that operates in response to data and instructions stored in an associated memory.

The belt 102 is preferably an endless-loop polishing belt. In its simplest form, the belt 102 is made with a single endless layer that provides both the surface for polishing and the mechanical strength for mounting, tensioning and tracking the belt on the rollers 104, 106. The belt 102 for polishing a workpiece such as the wafer 116 in the chemical mechanical polishing system 100 includes a polymeric layer forming an endless loop having a predetermined width and a predetermined length to fit the chemical mechanical polishing system 100. The belt 102 includes a top or polishing surface 126 on one side of the endless loop and an opposing bottom layer 127.

The polishing surface 126 can be any suitable polishing material with sufficient strength, flexibility, and durability. In one preferred embodiment, the polishing surface 126 is manufactured of a single, substantially uniform layer of polymeric material such as polyurethane. However, in other embodiments, the polishing material may be made of any suitable polymeric material having a substantially uniform thickness and structure including rubbers or plastics.

The slurry dispenser 112 dispenses a slurry onto the belt assembly 102. Generally, the slurry includes two components. Different applications will require different components of the slurry, depending on the material to be removed or polished. In one example, abrasive particles such as silicon dioxide or alumina are combined with a chemical such as potassium hydroxide. The chemical operates to soften or hydrate the surface and the abrasive particles operate to remove the surface material. The exact components of the slurry are chosen based on the material to be polished or planarized. For example, the slurry components for planarizing a silicon dioxide layer on the surface 117 of the wafer 116 will differ from the slurry components for planarizing a metal layer on the surface 117. Similarly, the slurry components appropriate for a tungsten metal layer will be different from the components for a copper layer, which is softer than tungsten. For uniform planarization or polishing, the slurry preferably will be distributed evenly across the surface 117 of the wafer 116.

The conditioner 114 treats the surface 126 of the belt 102 to keep the belt's roughness or abrasiveness relatively constant. Normally, as the belt 102 planarizes or polishes the wafer 116, some of the material removed from the wafer 116 is deposited onto the surface 126 of the belt 102. If too much material from the surface 117 of wafer 116 is deposited onto the belt surface 117, the removal rate of the belt 102 will drop quickly and the uniformity of abrasion across the wafer will be degraded. The conditioner 114 cleans and roughens the surface of the belt 102.

The wafer 116 is mounted on the polishing head 110. The wafer 116 may be mounted and retained in place by vacuum force or by any other suitable mechanical technique. The polishing head 110 is mounted on an arm and is movable under control of the controller 118. The polishing head 110 applies a polishing pressure to the wafer 116 against the belt 102. The polishing pressure is indicated in FIG. 1 by the arrow 132.

To further control the polishing pressure, the platen assembly 108 is located opposite the polishing head 110 below the wafer 116. The belt 102 passes between the polishing surface 117 of the wafer 116 and the platen assembly 108. The platen assembly 108 applies pressure to the belt 102 by supplying pressurized air to the underside of the belt 102

Figure 2:
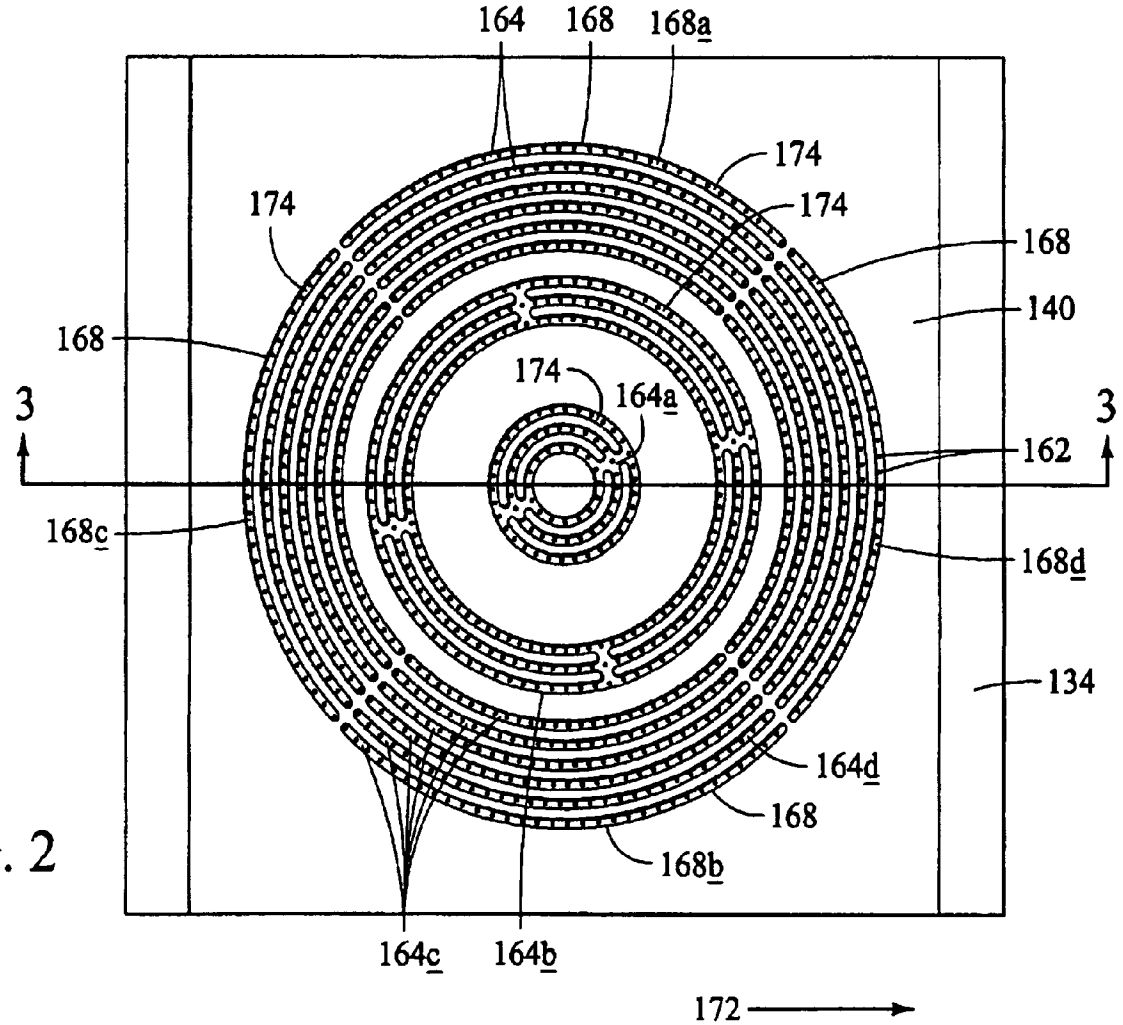
FIG. 2 is a top plan view of an air platen assembly.
Figure 3:
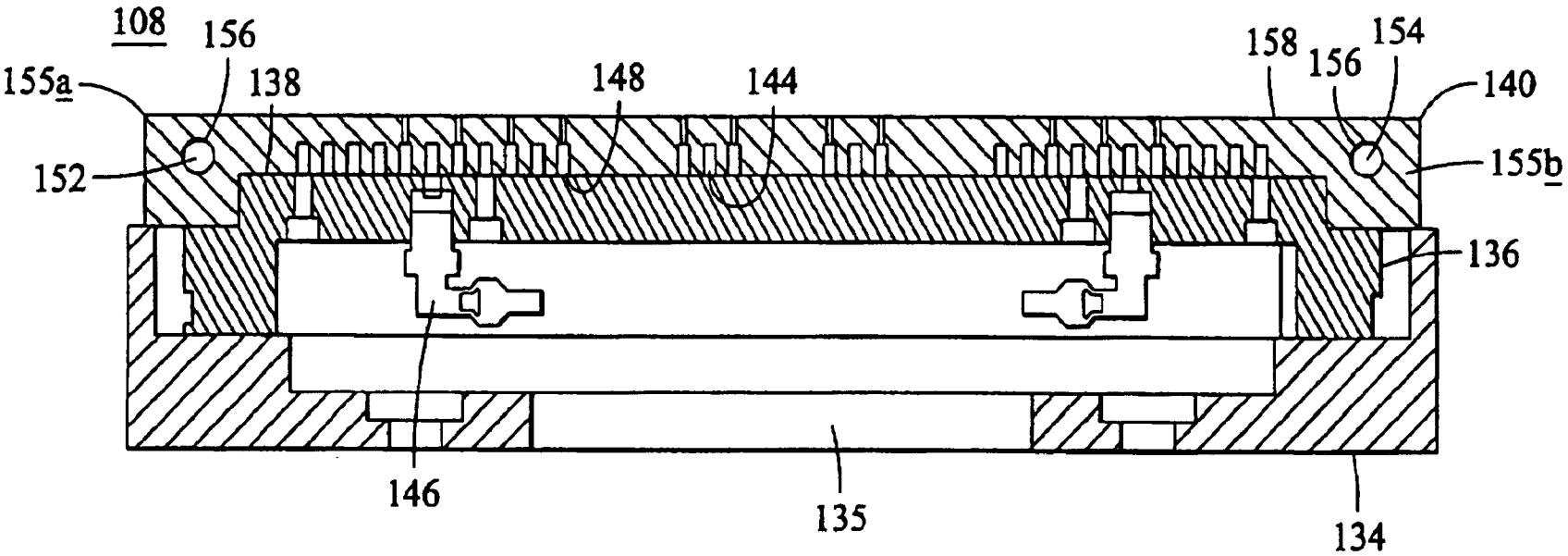
FIG. 3 is a side plan view of an air platen assembly of FIG. 2 taken along the line 3—3.

As shown in FIGS. 2 & 3, the platen assembly 108 includes a base 134, a support plate 136, a gasket 138, and an air platen 140. The base 134 supports the platen assembly 108, and the support plate 136 rests on the base 134. The support plate 136 is attached to the base 134 via a series of fasteners, for example set screws. Preferably, the base 134 and support plate 136 are made of stainless steel, although other types of suitable metals may also be used. The support plate 136 includes a plurality of openings 144. The openings 144 act as air ports and, as will be more fully described below, allow air to pass through from air hoses (not shown) to the air platen 140 via fittings 146 attached to the support plate 136 and air platen 140 so that the air platen 140 may provide a cushion of air to the belt 102.

The gasket 138 is located between the support plate 136 and the air platen 140, and provides an airtight seal so that the air remains pressurized. Preferably, the gasket 138 is a 70 durometer EPDM gasket. However, any suitable material, such as elastomerics, may be used that can tolerate water and slurry. As with the support plate 136, the gasket 138 also has a plurality of openings 148 to allow air to pass through to the air platen 140. When the gasket 138 is placed over the support plate 136, the openings 144, 148 of the support plate 136 and the gasket 138 align with each other.

The air platen 140 preferably made of an aluminum-bronze material, although in other embodiments the air platen may be made of other metals or heavy plastics. The air platen 140 is hard-mounted to the support plate 136 via a series of fasteners, with the gasket 138 between them, as described above.

Figure 4:
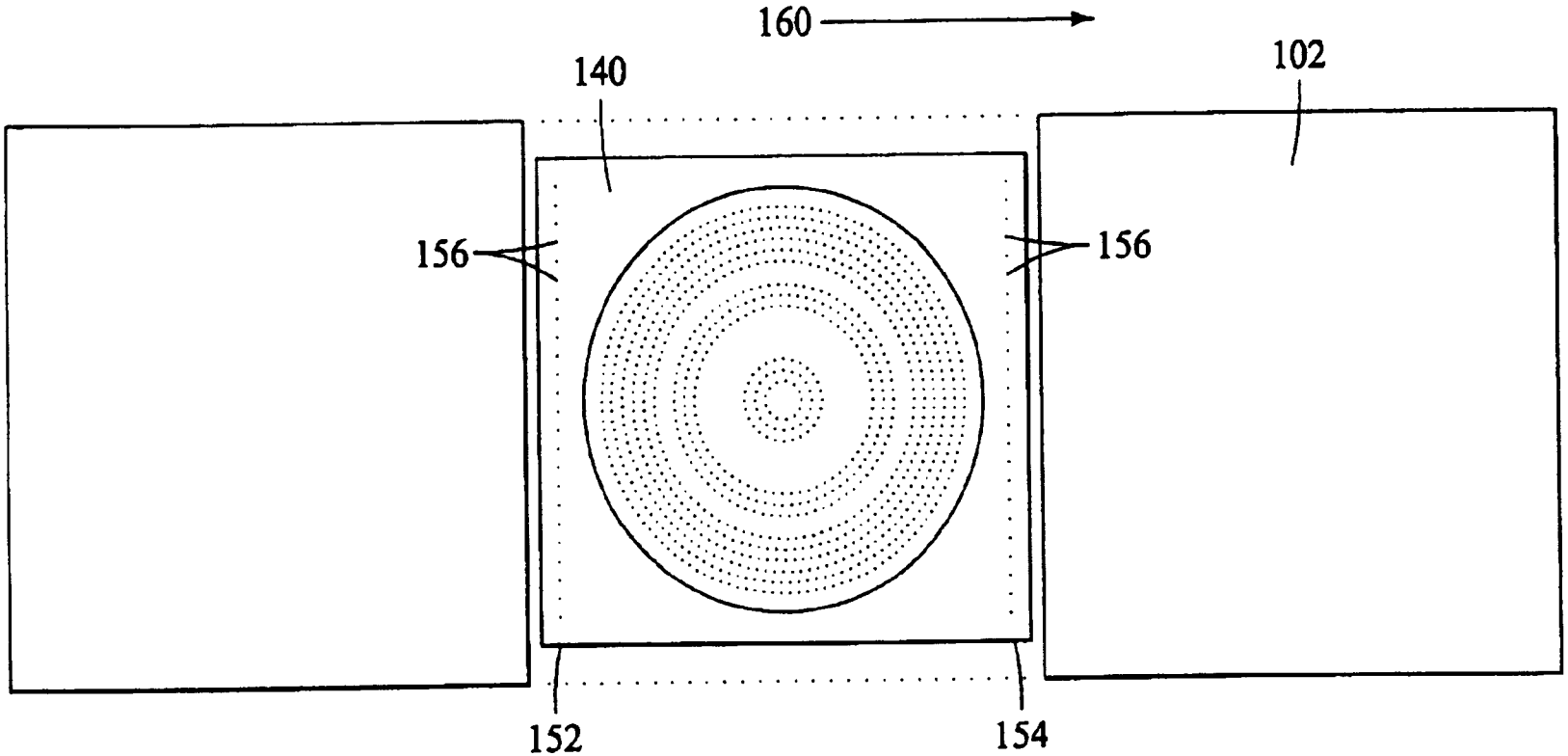
FIG. 4 is a top plan view of an air platen assembly and belt with a portion of the belt that passes over the air platen assembly cut away.

A pair of channels 152, 154, located at opposite ends 155*a*, 155*b* of the air platen 140, pass through the air platen 140 in a direction perpendicular to the direction of travel of the belt 102. When the CMP system 100 is in use, one of the channels 152, 154 is sealed up, and the other channel 152, 154 has a tube (not shown) connected to it. A lubricating liquid, such as water, passes through the tube and, into the channel. As shown in FIGS. 3 & 4, a series of passageways 156 extending upwardly from each of the channels 152, 154 to a top surface 158 of the air platen 140 facilitates the passing of the lubricating liquid from the channel to the belt 102 so that the belt 102 may be lubricated as it passes over the platen assembly 108.

The direction of the belt 102 dictates which channel 152, 154 acts as a throughway for the lubricating liquid, so that the belt 102 is lubricated before it passes over the platen assembly 108. For example, in FIG. 4, if the belt 102 is traveling in the direction depicted by the arrow 160, the channel depicted as 152 would provide a throughway for the lubricating liquid to lubricate the belt 102.

Referring to FIG. 2, the air platen 140 has a plurality of openings 162 that are divided into ring-like, concentric zones 164. As will be more fully described below, when the CMP system 100 is in use the openings 162 have pressurized air passing through them in order to provide a cushion of air that supports the belt 102 as a wafer 116 is being planarized. There is an innerzone 164*a*, which in a preferred embodiment is made up of three circular rows of openings 162, although in other embodiments the number of rows may be varied. A midzone 164*b* is also provided, which also has three circularly shaped rows of openings 162. As with the innerzone 164*a*, however, the number of rows associated with the midzone 164*b* may also be varied.

The remaining zones 164, or outerzones 164*c*, each preferably has one row of openings 162. The number of outerzones 164*c* may be varied. However, there should be a sufficient number of outerzones 164*c* so that at least one outermost zone, depicted as 164*d*, extends past the outer edge 166 of a wafer 116 to be planarized. Having at least one outerzone 164*d* extend past the wafer's outer edge 166 will allow for control over planarization at the edge 166 of the wafer 116. In a preferred embodiment, there will be six outerzones 164*c* in addition to the innerzone 164*a* and the midzone 164*b*.

Each outerzone 164*c* is divided into sections or quarters 168. If the belt 102 is moving in a direction indicated by an arrow 172, the outerzones 164*c* are each divided into a top quarter 168*a*, a bottom quarter 168*b*, a leading edge quarter 168*c*, and a trailing edge quarter 168*d*. The leading edge quarter 168*c* is the quarter a portion of the belt 102 will pass over first, and the trailing edge quarter 168*d* is the quarter the portion of the belt 102 will pass over subsequent to the leading edge quarter 168*c*.

Each quarter 168 within an outerzone 164*c* is separate from the other quarters 168 within the outerzone 164*c*, and each quarter 168 and the innerzone 164*a* and midzone 164*b* each acts as an independent air channel 174. Each independent air channel 174 has its own air supply hose (not shown) that preferably supplies pressurized clean dry air. Preferably, each hose is attached to an independent air channel 174 through the fitting 146 connected to the support plate 136.

When a CMP system 100 is being used to planarize wafers 116, pressurized air passes from the air supply hose into its corresponding independent air channel 174. The air then passes through the openings 162 in the air platen 140, and provides a cushion of air to the bottom surface 127 of the belt 102 in order to support the belt 102 as pressure is applied to a wafer 116 to be planarized.

Figure 5:
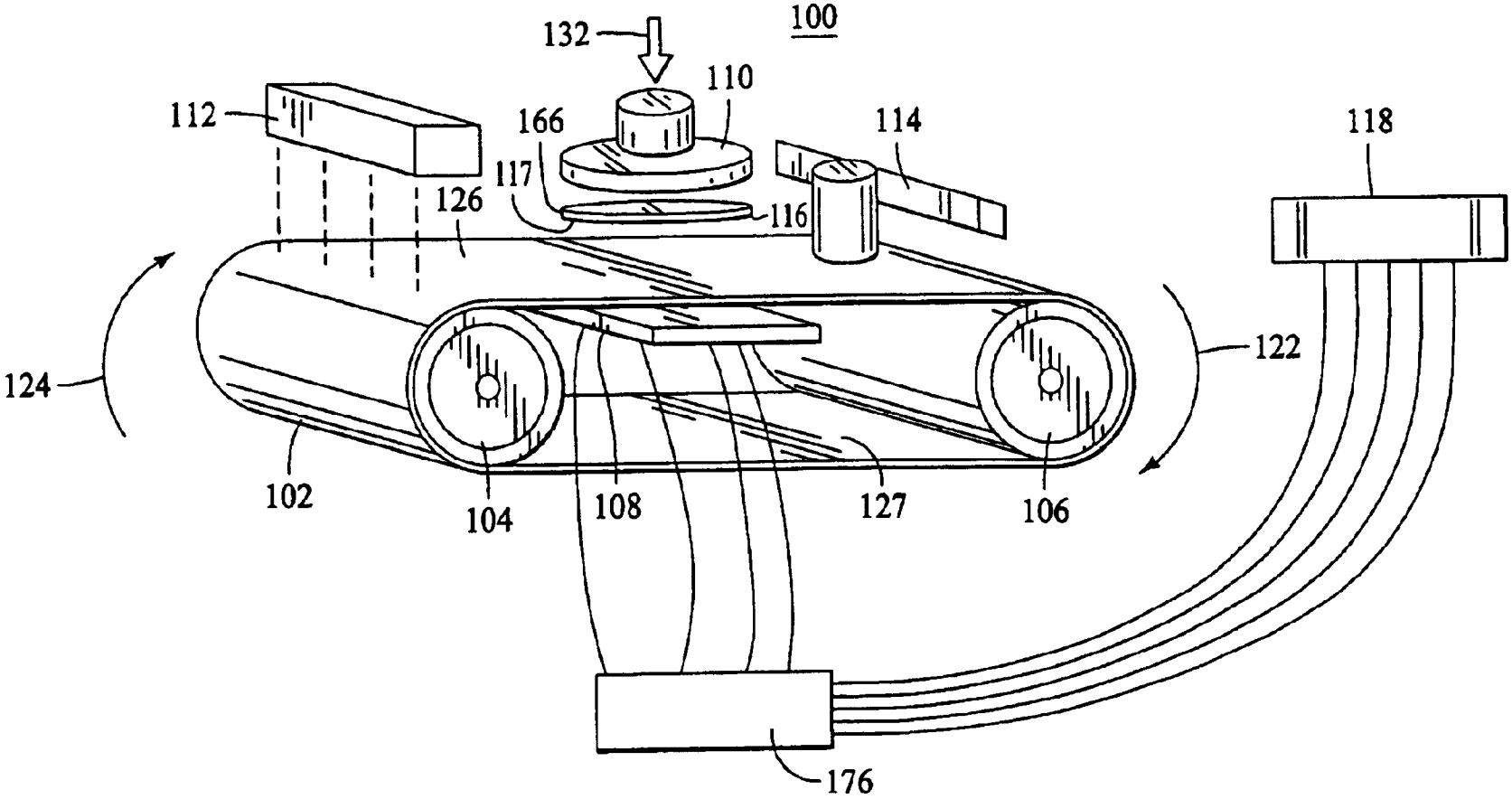
FIG. 5 is the linear chemical mechanical polishing system of FIG. 1 with the controller and the air platen assembly electrically connected with the air regulators.

Referring now to FIGS. 1 & 5, a plurality of pressure regulators 170 is attached with the zones 164 of the air platen 140 to monitor the pressure of the air being supplied. The regulators 170 are attached with the zones 164 via air hoses that are connected to the fittings 146. The air hoses, which are typically made of polyethylene, are run through a cutout 135 (FIG. 3) in the base 134 in order to be attached to the fittings 146. In a preferred embodiment, the innerzone 164*a* and midzone 164*b* each has one regulator 170 connected with it, and each outerzone 164*c* has three regulators connected with it. For each outerzone 164*c*, one regulator 170 is connected with the top and the bottom quarters 168*a*, 168*b*, one regulator 170 is attached with the trailing edge quarter 168*d*, and one regulator 170 is attached with the leading edge quarter 168*c*.

The regulators 170 monitor the air pressure at each of the independent air channels 174. Generally, when the platen assembly 108 is to be used, the pressure of the air to be supplied to the platen assembly 108 is set to a predetermined "set point". The set point is process-dependent, and may vary for different operations. The regulators 170 monitor the pressure of the air being supplied to the platen assembly 108 to ensure that the pressure falls within a predetermined target range.

The type of regulator used during the planarization process dictates what happens if the pressure falls outside the target range. For example, if a manual regulator is used to monitor the air pressure, a gauge will register the pressure. An operator may then visually determine if the pressure has fallen outside the target range through standard procedures such as periodic inspections.

Alternatively, other types of regulators may adjust the pressure back to the set point if the pressure is detected to fall outside the target range. By way of example, and as shown in FIG. 5, electropneumatic regulators 176 can be used to provide this type of adjustment. The electropneumatic regulators 176 are each connected with the controller 118. The controller 118 provides the set point to the electropneumatic regulators. Each electropneumatic regulator includes a controller (the "electropneumatic controller", not shown) that receives the set point information from the controller 118. During the polishing process, the pressure of the air is periodically measured, and the electropneumatic controller receives the measurement. If the electropneumatic controller determines that the measurement is outside the target range, it generates a signal to adjust the pressure back to the set point. Pressure measurements are typically taken several times per second.

The advantages of the above-described embodiments of the invention are numerous. For example, having a separate supply of pressurized air for each independent air channel allows greater control over the air pressure at different portions of the belt, which in turn minimizes the problem of edge exclusion. Edge exclusion occurs when an outer portion of the wafer does not receive the same degree of polishing action as the balance of the wafer. The result is a reduction of usable area for production that is made available. The platen assembly herein described minimizes edge exclusion by having the air pressure support the belt so that the polishing action over the entire wafer is substantially uniform.

Having at least one outer zone extend beyond the diameter of the wafer will further minimize the problem of edge exclusion. The portions of the belt supported by air coming from this zone will be no less supported than the portions of the belt supported by the remaining zones. This in turn will allow for greater control over the amount of polishing performed at the edge of the wafer, and will ensure that the outer part of the wafer is subject to the same degree of polishing as the balance of the wafer.

For this same reason, having at least one outer zone extend beyond the diameter of the wafer will also minimize a phenomenon known as "dig in". Dig in occurs when the polishing head digs into the outer edge of the wafer and causes a higher removal rate at the wafer edge than the remainder of the wafer. An insufficiently supported belt multiplies this tendency, and the resultant dig in will reduce the useable area of the wafer.

The embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

What is claimed is:

1. An air platen comprising:

a plurality of concentric rings each having a plurality of channels in order to provide a cushion of air to a CMP belt, said plurality of rings, except for two inner-most rings, each having a top quarter, a bottom quarter, a leading edge quarter, and a trailing edge quarter, each of said quarters and said inner-most rings being an independent air passage for receiving a supply of pressurized air, wherein at least one of said plurality of rings is oriented to extend beyond an outer edge of a wafer to be planarized by said CMP belt;

one pressure regulator connected with each of said inner-most rings; and three pressure regulators connected with each of the remaining of said rings.

2. The air platen of claim 1 further comprising two channels passing through said air platen, said channels each having a plurality of passages extending upwardly from said channel to a top surface of said platen.

3. The air platen assembly of claim 1, wherein one of said three regulators is connected with said top quarter and said bottom quarter, a second of said three regulators is connected with said leading edge quarter, and a third of said three regulators is connected with said trailing edge quarter of each of said remaining rings.

4. The air platen assembly of claim 3, wherein said regulators are manual regulators that each monitors the pressure of said air.

5. The air platen assembly of claim 3, wherein said regulators are electro-pneumatic regulators that each monitors the pressure of said air and that each adjusts said air pressure to each of said independent air passages to a preset value if said pressure falls outside of a preset target range.

6. The air platen assembly of claim 1 further comprising an aluminum bronze material.

7. An air platen, comprising:

eight concentric rings, each having a plurality of channels in order to provide a cushion of air to a CMP belt, an outer six rings each having a top quarter, a bottom quarter, a leading edge quarter, and a trailing edge quarter, each of said quarters and two inner-most rings being an independent air passage for receiving a supply of pressurized air;

one pressure regulator connected with each of said inner-most rings;

three pressure regulators connected with each of said six outer rings, one of said three regulators being connected with said top quarter and said bottom quarter, a second of said three regulators being connected with said leading edge quarter, and a third of said three regulators being connected with said trailing edge quarter of each of said remaining rings; and two channels passing through said air platen, said channels each having a plurality of passages extending upwardly from said channel to a top surface of said air platen;

whereby at least one of said outer six rings extends beyond an outer edge of a wafer to be planarized by said CMP belt.

8. The air platen assembly of claim 7 further comprising an aluminum bronze material.

9. The air platen assembly of claim 7, wherein said regulators are manual regulators that each monitors the pressure of said air.

10. The air platen assembly of claim 7, wherein said regulators are electro-pneumatic regulators that each monitors the pressure of said air and that each adjusts said air pressure to each of said independent air passages to a preset value if said pressure falls outside of a preset target range.

11. An air platen assembly comprising:

a platen having a plurality of concentric rings, each of said rings having a plurality of openings in order to provide a cushion of air to a CMP belt, at least one of said plurality of rings extending beyond an outer edge of a wafer to be planarized by said CMP belt, wherein said plurality of rings, except for two inner-most rings, each has a top quarter, a bottom quarter, a leading edge quarter, and a trailing edge quarter, each of said quarters and said inner-most rings being an independent air passage for receiving a supply of pressurized air;

a plurality of regulators connected with said rings in order to regulate the pressure of said air being supplied, wherein said two inner-most rings is each connected with one regulator, and a remainder of said plurality of rings is each connected with three regulators, and wherein one of said three regulators is connected with said top quarter and said bottom quarter, a second of said three regulators is connected with said leading edge quarter, and a third of said three regulators is connected with said trailing edge quarter of each of said remaining rings;

a support attached with said platen, said support having a plurality of air ports for pressurized air to pass to said rings of said platen;

a gasket positioned between said support and said platen, said gasket having a plurality of cutouts that align with said openings and said air ports; and a base that supports said support.

* * * * *